United States Patent [19]

Leffler

[11] 4,366,985

[45] Jan. 4, 1983

[54] ADJUSTABLE HEADREST FOR TREATMENT CHAIR

[75] Inventor: Dennis F. Leffler, Charlotte, N.C.

[73] Assignee: Pelton & Crane, Charlotte, N.C.

[21] Appl. No.: 234,121

[22] Filed: Feb. 13, 1981

[51] Int. Cl.[3] ..... A47C 7/38

[52] U.S. Cl. ..... 297/409; 297/410

[58] Field of Search ..... 297/409, 408, 410, 391, 297/405

[56] References Cited

U.S. PATENT DOCUMENTS

| | | | |
|---|---|---|---|
| 535,783 | 3/1895 | Archer | 297/408 |
| 945,194 | 1/1910 | Ritter | 297/405 |
| 1,531,170 | 3/1925 | Berninghaus | 297/410 |
| 1,576,915 | 3/1926 | Koenigkramer | 297/409 |
| 2,434,007 | 1/1948 | O'Dea | 297/409 X |
| 2,586,417 | 2/1952 | Cole | 297/409 |
| 2,666,476 | 1/1954 | Lycan | 297/410 |
| 3,692,356 | 9/1972 | Mertens | 297/408 |

*Primary Examiner*—Francis K. Zugel

*Attorney, Agent, or Firm*—Richard H. Brink

[57] ABSTRACT

An adjustable headrest particularly adapted for a dental, medical or the like treatment chair wherein it is necessary to have a patient's head in various positions. A supporting arm preferably of the four-bar linkage type having a first end for being pivotally mounted on any suitable support for attachment to a treatment chair and a second end being pivotally mounted on a headrest for movement of the headrest which approximates the normal motion of the patient's head. Locking mechanism is attached to the headrest and supporting arm to lock the headrest in any desired position with the use of one hand of the operator.

6 Claims, 7 Drawing Figures

ADJUSTABLE HEADREST FOR TREATMENT CHAIR

FIELD OF THE INVENTION

This invention relates to an adjustable headrest for a treatment chair such as is used by dentists, surgeons, beauticians and the like.

BACKGROUND OF THE INVENTION

Generally, adjustable headrests of the type normally utilized in the dental, medical or the like fields require both hands of the operator to adjust, one hand to hold the headrest in the selected position and the other hand to operate the locking mechanism. While recently some prior headrests have provided for adjustment with one hand, the headrests have not been entirely satisfactory. Another problem with adjustable headrests is that they generally have a hinge movement at the base of the headrest moving the headrest around a single pivot point. This movement does not simulate the normal movement of the patient's head. Due to the movement of the headrest around a single pivot point, the patient encounters unnecessary strain on the neck and head thereby resulting in discomfort particularly during long medical or dental procedures.

Still another problem presented with some prior adjustable headrests is that they do not have adequate locking means to prevent movement or slippage of the headrest when pressure is exerted in the patient's mouth by a dentist or surgeon.

SUMMARY OF THE INVENTION

Accordingly, it is the object of the present invention to overcome the above-defined problems with adjustable headrests previously utilized in the medical, dental or the like field.

It has been found by this invention that such problems may be overcome by providing an adjustable headrest mechanism comprising generally the following:

A headrest, supporting arm and support for attachment to a treatment chair in which one end of the supporting arm is pivotally mounted on the support and the other end of the supporting arm is pivotly mounted on the headrest to provide motion which approximates the natural motion of the head of a patient. The adjustable headrest further includes a locking assembly. The locking assembly includes an activating member slideably mounted on the headrest and being wedge-shaped at one end and a cam shaped member mounted on the moveable arm and bias means urging the wedge-shaped portion of the activating member into engagement with the cam to lock the headrest in the desired position.

When used in combination with a treatment chair having a backrest to receive the support, the activation of the headrest provides a normal position for the patient's head in any position.

Accordingly, this invention has provided an improved adjustable headrest which overcomes problems presented with prior headrests of this type for use on treatment chairs.

BRIEF DESCRIPTION OF THE DRAWINGS

Some of the objects and advantages of the invention having been stated other objects and advantages will appear when taken in conjunction with the accompanying drawings in which.

DETAILED DESCRIPTION OF ILLUSTRATED EMBODIMENT

Figure 1:
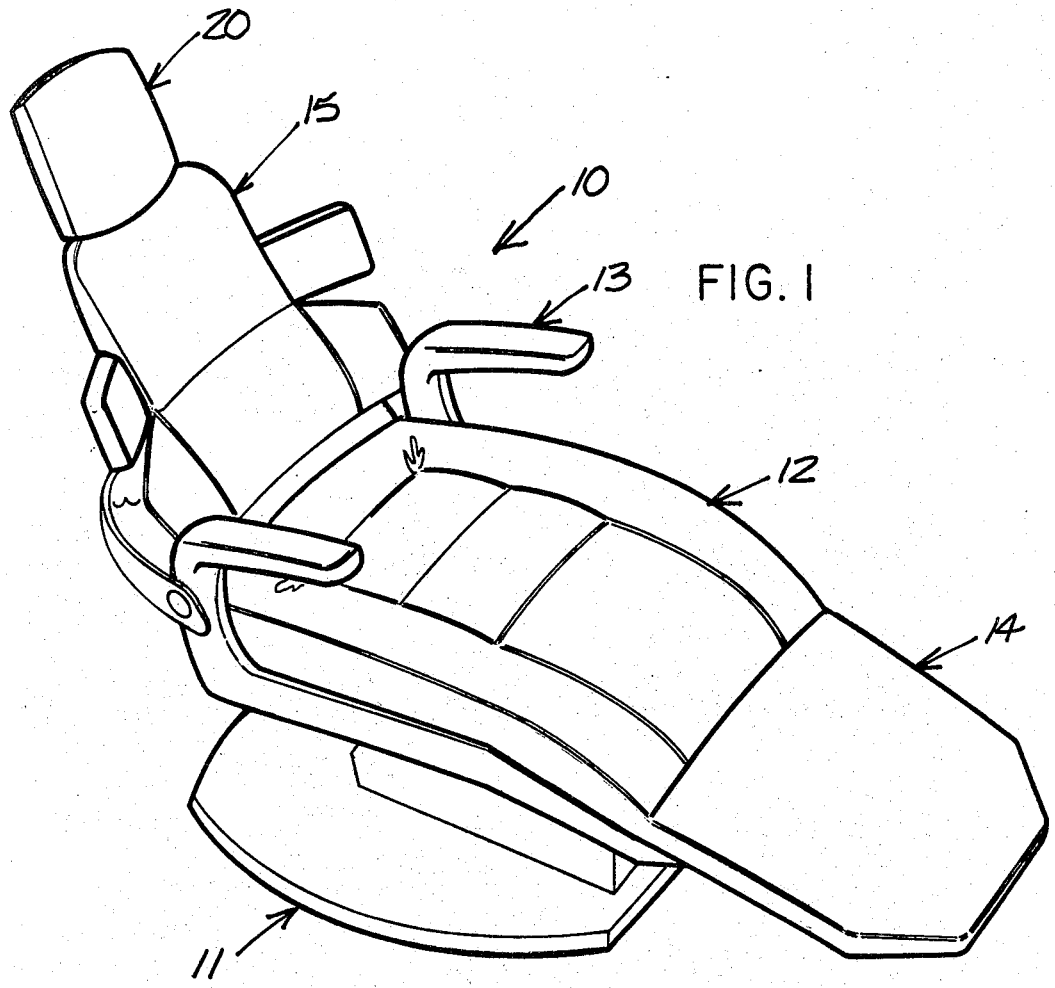
FIG. 1 is a perspective view of a treatment chair embodying the improved adjustable headrest.
Figure 2:
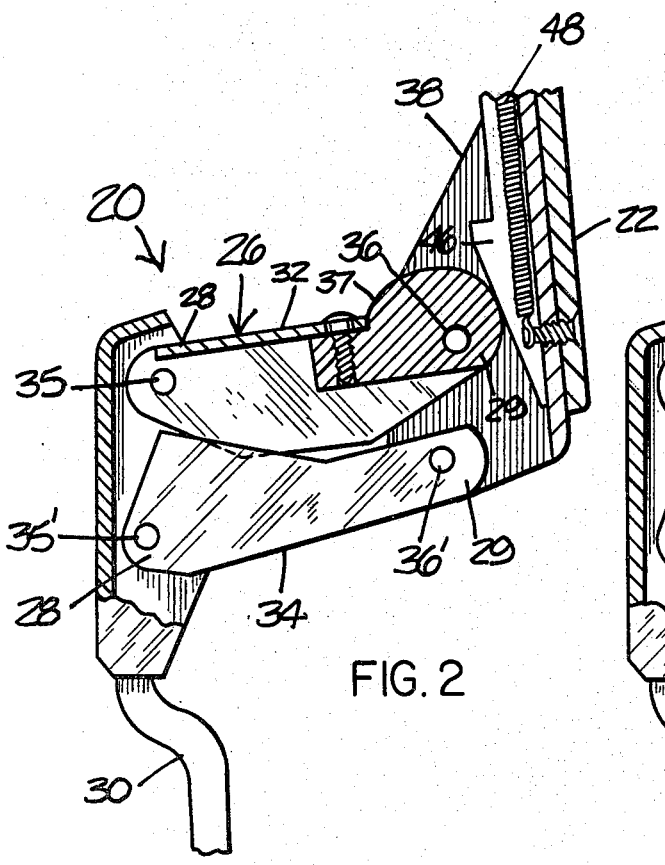
FIG. 2 is an enlarged vertical cross-section of a portion of the headrest linkage and locking mechanism in locked position.

Referring more specifically to the drawings and to FIG. 1 in particular, the numeral 10 broadly designates the treatment chair including a base 11, a seat 12, an armrest 13, a leg rest 14, a backrest broadly designated as 15 and the adjustable headrest broadly designated as 20.

Figure 5:
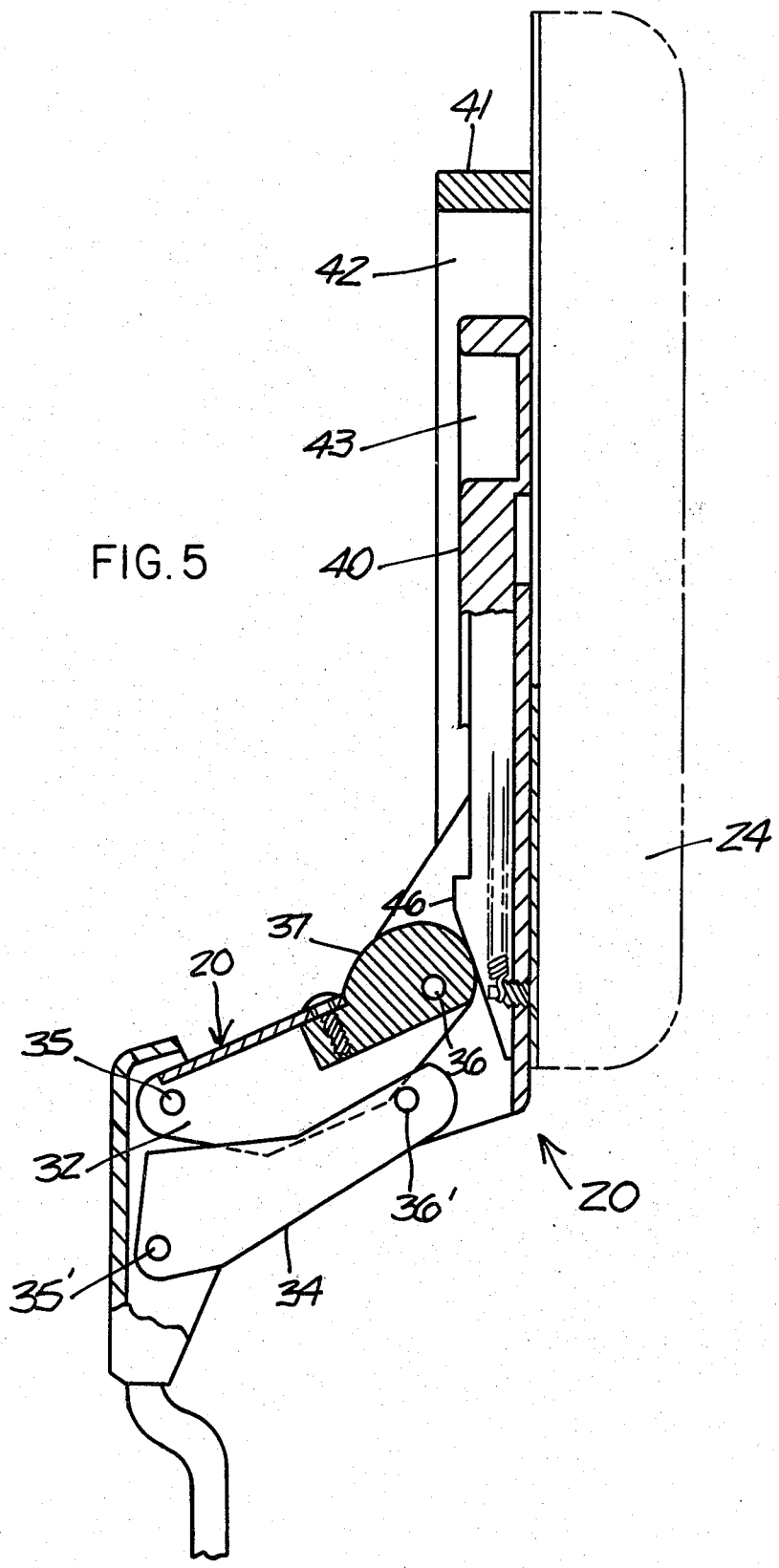
FIG. 5 is a sequential view of the horizontal cross-sectional of the improved adjustable headrest in vertical position.

Referring now to FIGS. 2, 3, 4, 5, 6 and 7, there is illustrated therein an adjustable headrest 20. Adjustable headrest 20 has a panel 22 to which headrest cushion 24 is attached as shown in FIG. 5. Headrest 20 further includes a supporting arm 26.

Supporting arm 26 is a moveable arm having a first end 28 for being pivotally mounted on back support 30 and a second end 29 pivotally mounted to and carrying headrest 22. The moveable arm 27 is preferably constructed of a four-bar linkage having two parallel pairs of oppositely disposed elongate members 32 and 34. The pairs may be in the form of U-shaped members as shown in the Figures. The ends of the four-bar linkage are attached to headrest 22 and support 30 by pivot pins 35, 35$^1$, 36 and 36$^1$ which pass through the ends of the four-bar linkage and headrest bracket 38 and support 30 and allow movement of the moveable arm to adjust the headrest. The distance between pins 35 and 35$^1$ is greater than the distance between pins 36 and 36$^1$ which allows the desired movement of headrest 22.

Elongate member 32 includes a cam 37 on the upper surface and near the point of attachment to the headrest for locking. The cam being a raised curved surface on elongate member 32.

The locking means provided for locking headrest 22 in any selected position adjustable relative to backrest 15 is largely disposed within bracket 41 attached to the rear of headrest 22. Locking lever arm 40 is slideably mounted within elongate slot 42 of bracket 41 to permit vertical motion of the lever. The lever arm has a finger grip 43 and a wedge-shaped lower portion 46. The lever arm is biased by spring 48 against headrest 22 which urges the wedge-shaped portion of the lever arm into engagement with cam 37.

Figure 3:
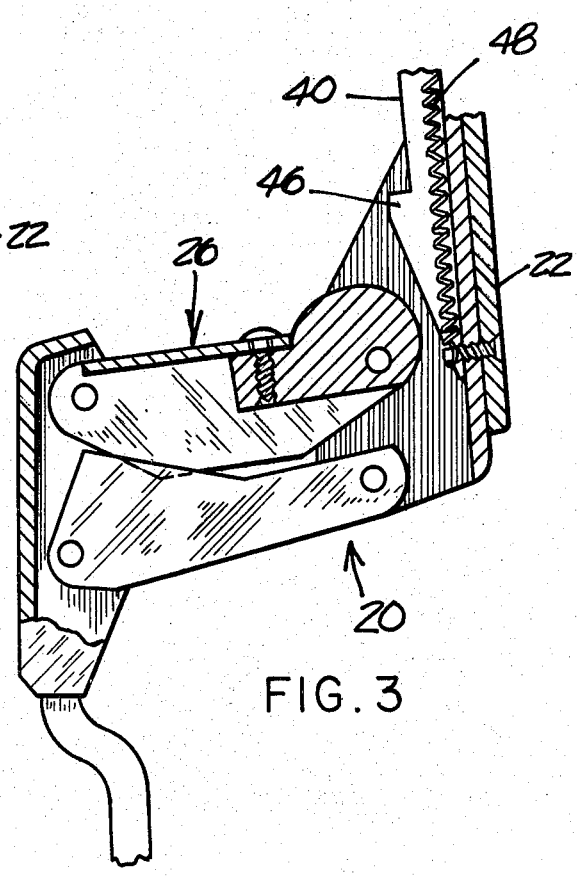
FIG. 3 is an enlarged vertical cross-section of a portion of the headrest linkage and locking mechanism in unlocked position.
Figure 4:
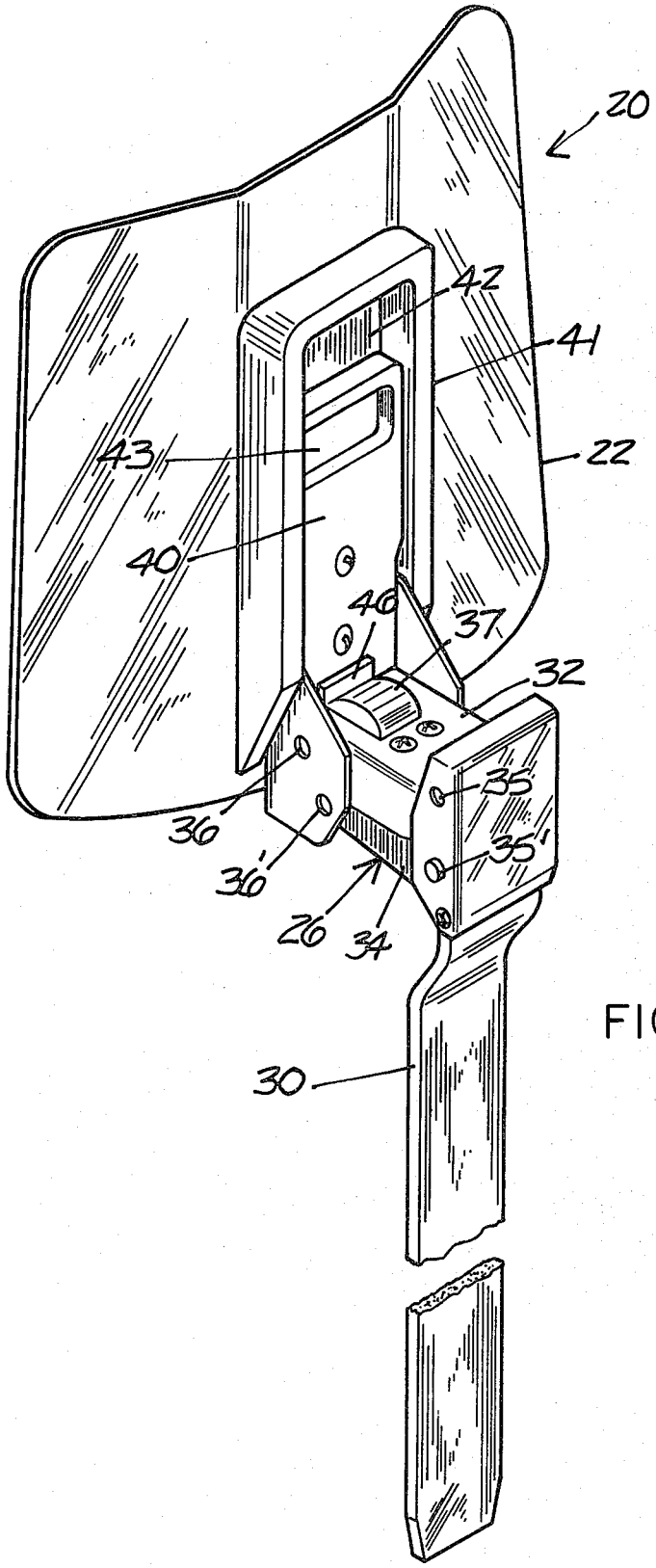
FIG. 4 is a rear perspective view of the improved adjustable headrest assembly.
Figure 6:
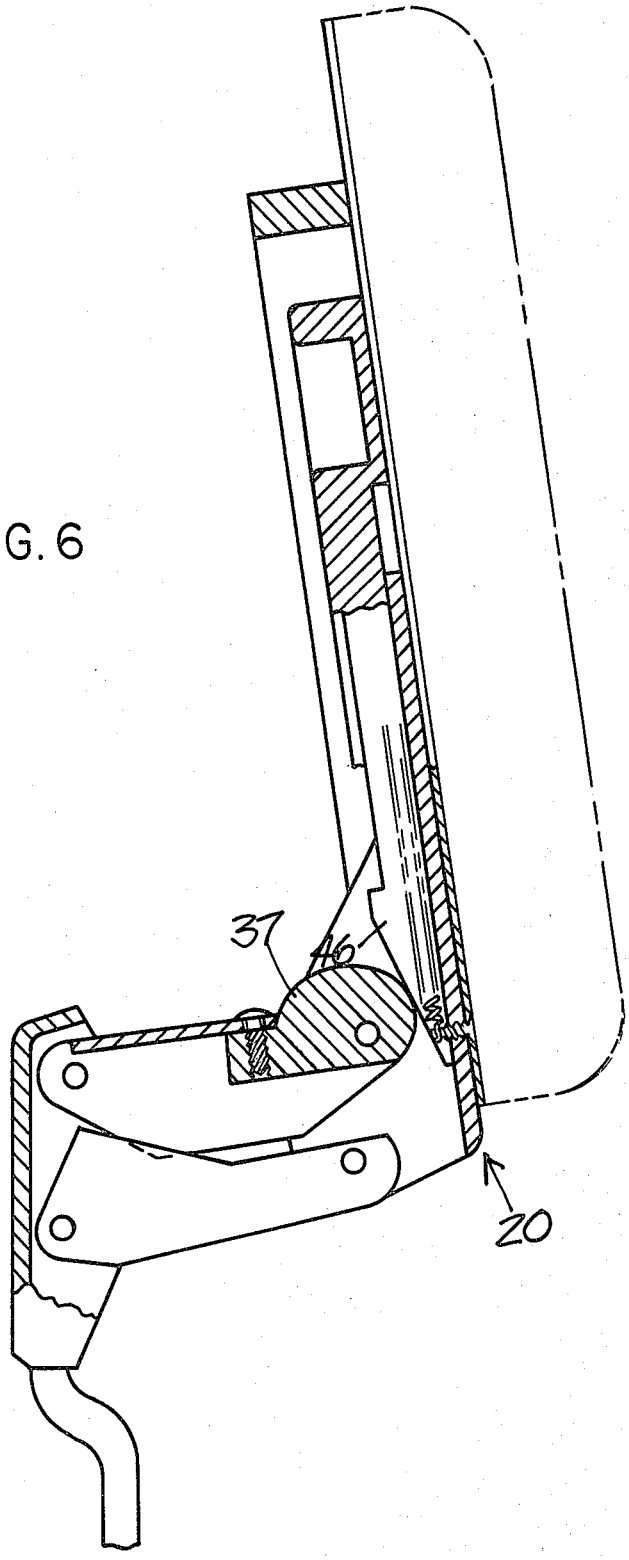
FIG. 6 is a sequential view of the horizontal cross-sectional of the improved adjustable headrest in intermediate position.
Figure 7:
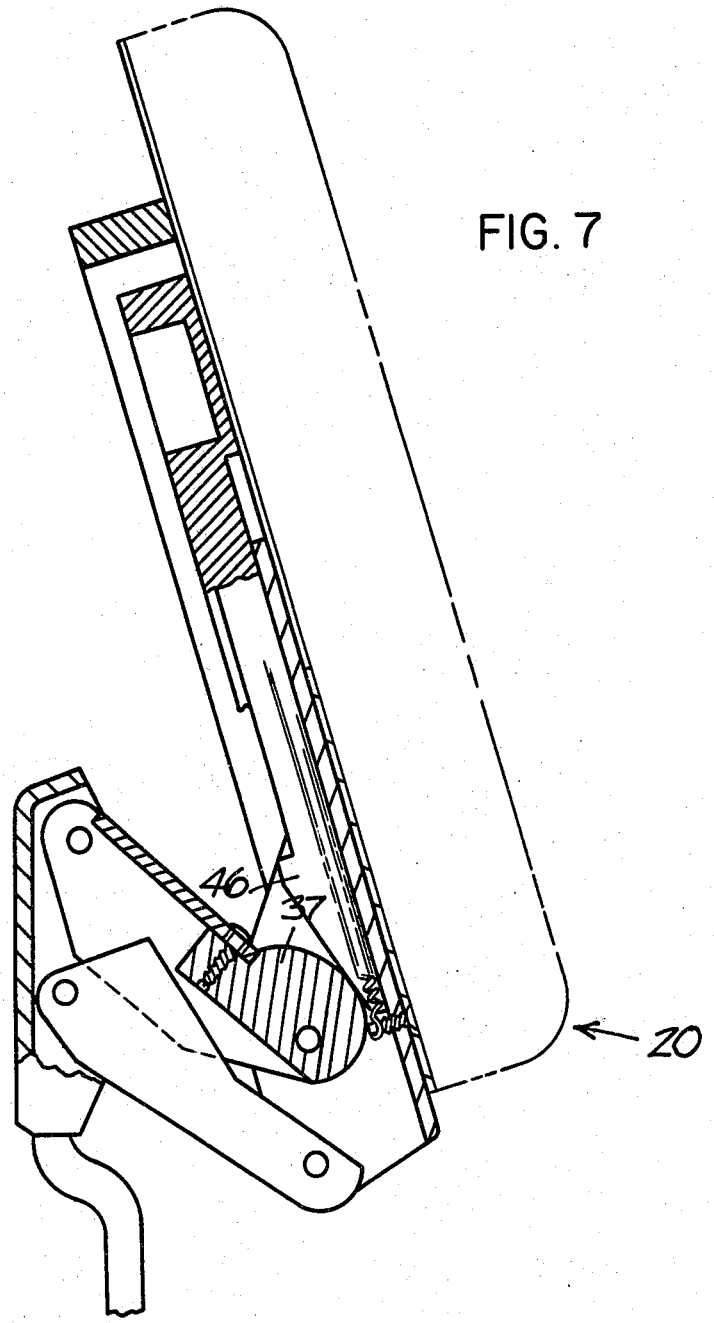
FIG. 7 is a sequential view of the horizontal cross-sectional of the improved adjustable headrest in downward position.

In operation to move the headrest finger grip 43 of lever arm 40 is grasped by the fingers of the operator while keeping a porition of the hand on the headrest. The lever arm is pulled toward the top of the headrest against the bias of spring 48. As the lever arm moves upward the wedge-shaped portion of the lever arm becomes disengaged from cam 37 as illustrated in FIG. 3. This permits supporting arm 26 to move about pivot pins 35, 35[1], 36 and 36[1] resulting in upward or downward movement as desired of the headrest. When the desired position of the headrest is achieved lever arm 40 is released and spring 48 urges the wedge-shaped portion of the lever arm into engagement with cam 37 and thus locking the headrest in the desired position. As illustrated in FIGS. 5, 6 and 7 various positions of the headrest can be achieved from about five degrees forward of the vertical position to approximately sixty degrees rearward of the vertical position.

As the headrest is articulated by the four-bar linkage the natural movement of the head of the patient is approximated. Accordingly, the final position of the headrest is a natural position of the head of the patient.

Thus, according to this invention an improved adjustable headrest has been provided for a treatment chair for dental, medical or the like uses which overcomes the above-defined problems with prior treatment chair headrests.

While this invention has been described and exemplified in terms of its preferred embodiments those skilled in the art will appreciate that modifications can be made without departing from the spirit and scope of this invention.

What is claimed is:

1. An adjustable headrest for dental, medical or the like treatment chairs comprising:

a headrest;

a support for attachment to a treatment chair;

moveable arm means having a first end pivotally mounted on said support and a second end pivotally mounted on said headrest whereby movement of said headrest approximates the normal movement of the head of a patient; and locking means for said headrest including an activating member slideably mounted on said headrest said member being wedge-shaped at one end and a cam-shaped member mounted on said moveable arm and bias means normally urging said wedge-shaped portion of said member into engagement with said cam to lock said headrest in a desired position.

2. An adjustable headrest as set forth in claim 1 in which said moveable arm means comprises a four-bar linkage having two pairs of two bars oppositely disposed, wherein each pair is connected at one end to said support and at the other end to said headrest.

3. An adjustable headrest as set forth in claim 2 in which said two bars in each set are interconnected to produce an elongate single member.

4. An adjustable headrest as set forth in claim 1 wherein said bias means is a spring attached to said release and headrest so as to urge said release means towards said cam.

5. An adjustable headrest as set forth in claim 1 wherein said moveable arm means is attached to said headrest and to said support by parallel pivot pins.

6. An adjustable headrest as set forth in claim 1 including a headrest cushion secured to said headrest by a portion at the upper end thereof for providing a comfortable support for the head of the seated patient.

* * * * *